US011284755B2

(12) United States Patent
Patel et al.

(10) Patent No.: US 11,284,755 B2
(45) Date of Patent: Mar. 29, 2022

(54) TOILET SEAT

(71) Applicants: Deepa Patel, Irving, TX (US); Prajeshkumar Patel, Irving, TX (US)

(72) Inventors: Deepa Patel, Irving, TX (US); Prajeshkumar Patel, Irving, TX (US)

( * ) Notice: Subject to any disclaimer, the term of this patent is extended or adjusted under 35 U.S.C. 154(b) by 0 days.

(21) Appl. No.: 16/221,476

(22) Filed: Dec. 15, 2018

(65) Prior Publication Data

US 2019/0183299 A1 Jun. 20, 2019

Related U.S. Application Data

(60) Provisional application No. 62/599,390, filed on Dec. 15, 2017.

(51) Int. Cl.
*A47K 13/10* (2006.01)
*A47K 13/24* (2006.01)

(52) U.S. Cl.
CPC ..... *A47K 13/10* (2013.01); *A47K 13/24* (2013.01)

(58) Field of Classification Search
CPC ..... A47K 13/10
USPC ..... 4/667
See application file for complete search history.

(56) References Cited

U.S. PATENT DOCUMENTS 4,777,671 A * 10/1988 Kearns ..... A61G 7/1007 4/566.1
2002/0124308 A1* 9/2002 Ward ..... A61G 7/1007 4/667
2011/0258771 A1* 10/2011 Hammer ..... A61G 5/1002 4/667
2015/0327740 A1* 11/2015 Edwards ..... A47K 17/02 4/254

* cited by examiner

*Primary Examiner* — Lauren A Crane
(74) *Attorney, Agent, or Firm* — Leavitt Eldredge Law Firm

(57) ABSTRACT

A toilet seat includes a body with a first end and a second end connected by a top surface; a base extending from the body and to rest on a top rim of a toilet; and a connection device extending from the second end to secure the toilet seat to the toilet; the base positions the first end at a height greater than the second end of the body, thereby creating a sloped in the top surface of the body.

3 Claims, 5 Drawing Sheets

TOILET SEAT

BACKGROUND

1. Field of the Invention

The present invention relates generally to bathroom furniture, and more specifically, to a toilet seat for elevating a person's feet during use of the toilet.

2. Description of Related Art

Toilets are well known in the art and are a common feature in most households. For example, FIG. 1 depicts a conventional toilet 101 having a seat 103 elevated above a bathroom floor 105. During use, a user (not shown) sits on seat 103 with feet on the bathroom floor 105, thereby resting in a seated position.

One of the problems commonly associated with system 101 is the seated position of the user. It should be understood that a squatted position provides the ideal posture for defecation, and therefore the seated position is not ideal.

Accordingly, although great strides have been made in the area of toilets, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
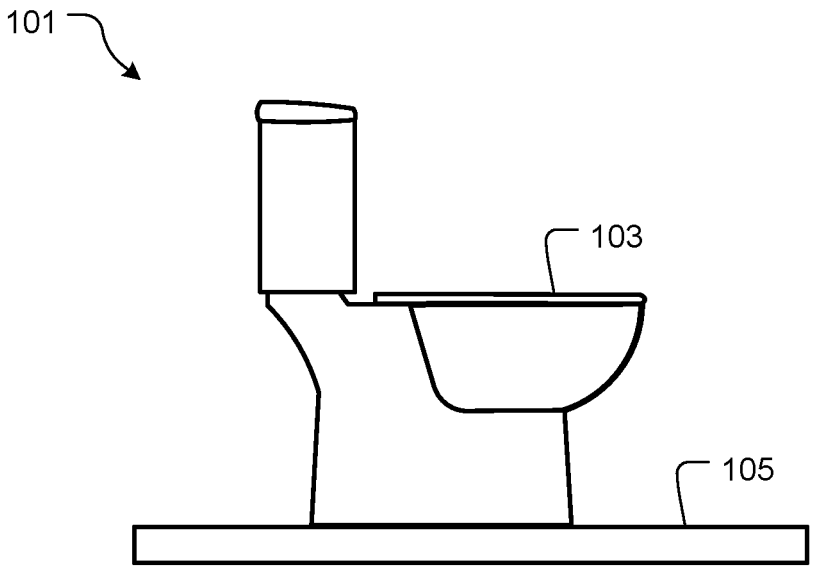
FIG. 1 (Prior Art)
FIG. 1 is a side view of a common toilet system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional toilet seats. Specifically, the present invention provides a means to elevate a user's feet, thereby providing an ideal position for defecation. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
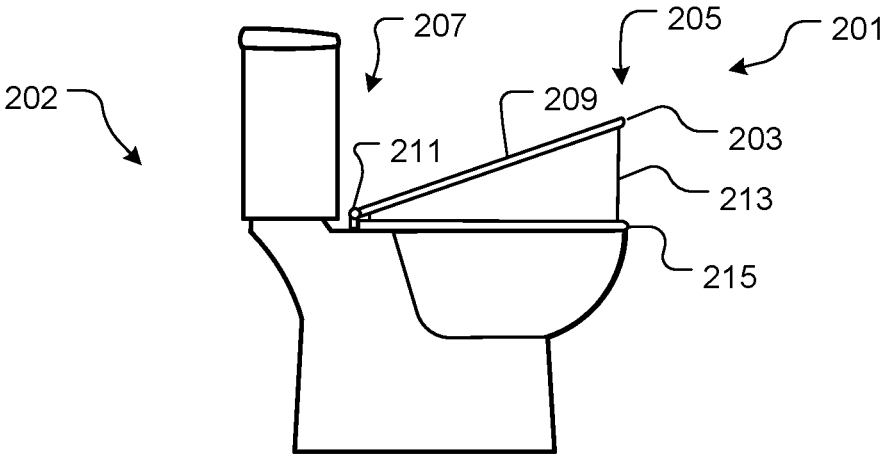
FIG. 2 is a side view of a toilet seat in use with a toilet in accordance with a preferred embodiment of the present application.

Referring now to the drawings wherein like reference characters identify corresponding or similar elements throughout the several views, FIG. 2 depicts a side view of a toilet seat 201 attached to a toilet 202 in accordance with a preferred embodiment of the present application. It will be appreciated that seat 201 overcomes one or more of the above-listed problems commonly associated with conventional toilets.

In the contemplated embodiment, seat 201 includes body 203 having a first end 205 and a second end 207 with a top surface 209 extending therebetween. Seat 201 can include an attachment device 211, such as one or more hinges, configured to connect seat 201 to toilet 202.

Seat 201 further includes a base 213 configured to extend from body 203 to a lid 215 of toilet 202. It should be appreciated that base 213 is configured to hold first end 205 higher than second end 207, thereby placing top surface 209 in a slanted position.

It should be appreciated that one of the unique features believed characteristic of the present application is the base 213 providing a means to place body 203 in a slanted position. It should be appreciated that this feature causes the user to sit in a more squatted position, with their feet raised, thereby providing an improved posture for defecation. It should be appreciated that the materials and height of base 213 can vary as desired.

Figure 3:
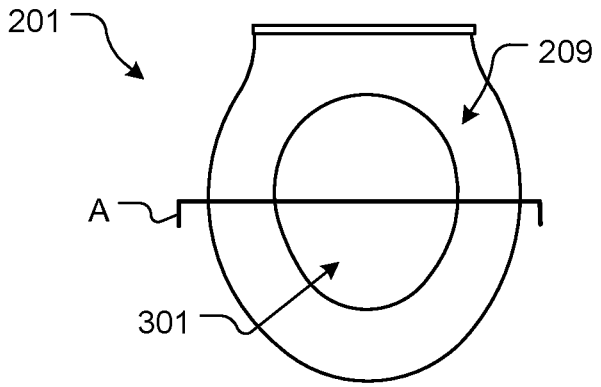
FIG. 3 is a top view of the toilet seat of FIG. 2.
Figure 4:
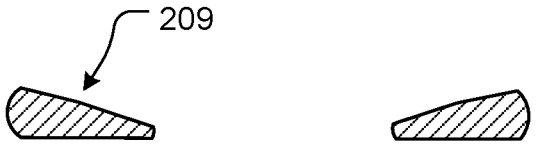
FIG. 4 is a cross sectional view of the toilet seat of FIG. 2.

In FIG. 3 a top view of seat 201 is shown with FIG. 4 correlating to line A. As shown, top surface 209 slopes inward toward center 301, thereby further providing improved positioning for the user.

Figure 5A:
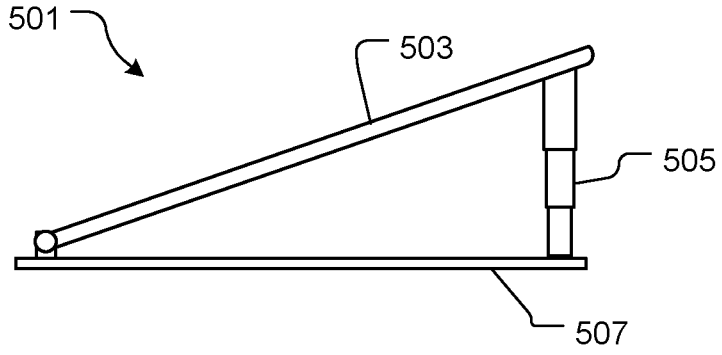
FIGS. 5A and 5B are side views of an alternative embodiment of a toilet seat in accordance with the present invention.
Figure 5B:
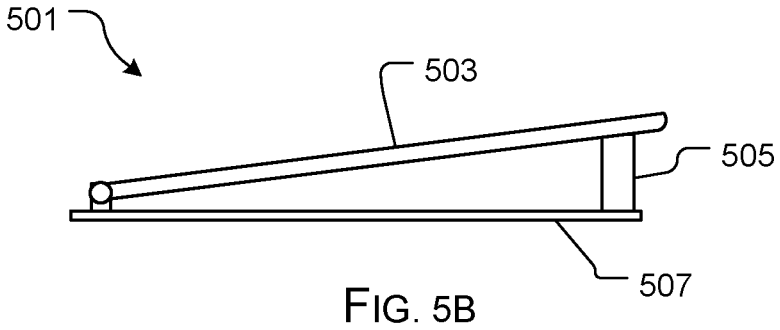

In FIGS. 5A and 5B, side views of an alternative embodiment of a toilet seat 501 in accordance with the present invention is shown. In this embodiment, a toilet seat body 503 is attached to a base 505, the base being adjustable to positioning body 503 at various heights above a rim 507. It is contemplated that the adjustability can be achieved via a telescoping mechanism, or any other mechanism known in the art. In addition, it should be appreciated that base 505 can be removable from body 503 or alternatively integrally secured thereon.

Figure 6:
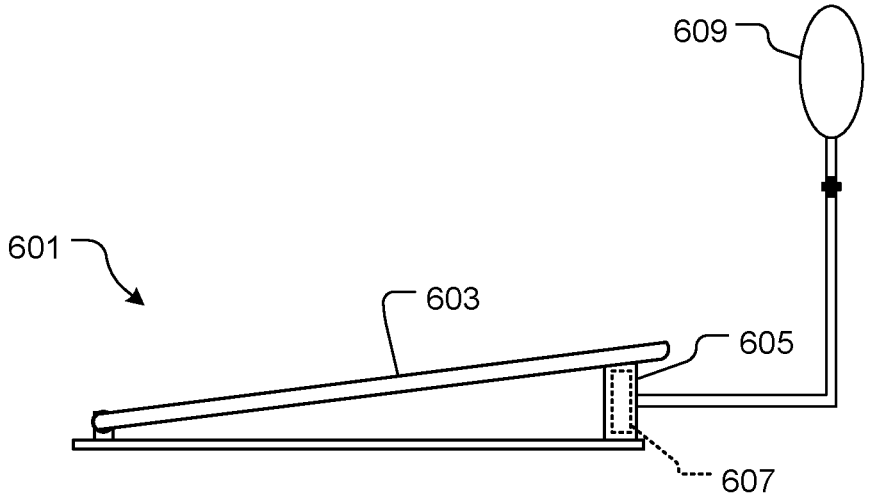
FIG. 6 is a side view of an alternative embodiment of a toilet seat in accordance with the present invention.

In FIG. 6, a side view depicts an alternative embodiment of a toilet seat 601 in accordance with the present invention. Seat 601 includes seat body 603 with a base 605 having an interior area 607 in communication with a hand pump 609. It should be appreciated that the user can utilize hand pump 609 to raise and lower base 605, thereby adjusting the height of seat body 603.

It must be understood that the teachings of the various systems discussed herein can be utilized together.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A toilet seat, comprising:

a body with a first end and a second end connected by a top surface;

a base extending from the body and configured to rest on a top rim of a toilet at a first end and configured to pivotally attach to the body at a second opposing end, the base is configured to be adjustable;

a hand pump in gaseous communication with the base, the hand pump is configured to direct air to the base, which in turn causes the base to increase in length and pivot the body relative to the top rim of the toilet; and a connection device extending from the second end of the body and configured to secure the toilet seat to the toilet;

wherein the base positions the first end at a height greater than the second end of the body, thereby creating a slope in the top surface of the body.

2. The toilet seat of claim 1, wherein the connection device is one or more hinges.

3. The toilet seat of claim 1, wherein the top surface slopes inward toward a central opening of the body.

* * * * *